United States Patent [19]

Oshima et al.

[11] Patent Number: 4,512,936

[45] Date of Patent: Apr. 23, 1985

[54] AERATION APPARATUS

[75] Inventors: Masao Oshima; Yutaka Kato; Mitsuhiko Ogasawara; Osamu Futamura, all of Tokyo, Japan

[73] Assignees: Ebara Corporation; Ebara-Infilco Co., Ltd., both of Japan

[21] Appl. No.: 393,723

[22] Filed: Jun. 30, 1982

[30] Foreign Application Priority Data

| | | | |
|---|---|---|---|
| Jul. 3, 1981 | [JP] | Japan | 56-103279 |
| Jul. 7, 1981 | [JP] | Japan | 56-105066 |
| Mar. 1, 1982 | [JP] | Japan | 57-30541 |

[51] Int. Cl.[3] ..... B01F 3/04

[52] U.S. Cl. ..... 261/93; 210/219; 210/221.2; 261/36 R; 366/102

[58] Field of Search ..... 261/36 R, 37, 91, 93; 210/219, 220, 221.2; 209/169, 170; 366/13, 102, 107; 435/312–315; 415/206, 207; 417/76, 84

[56] References Cited

U.S. PATENT DOCUMENTS

| | | | |
|---|---|---|---|
| 366,991 | 7/1887 | Andrews | 261/93 X |
| 1,242,445 | 10/1917 | Ittner | 261/93 X |
| 2,293,183 | 8/1942 | Walker | 261/93 |
| 2,463,975 | 3/1949 | Johnson | 261/93 X |
| 2,772,863 | 12/1956 | Harney et al. | 261/93 X |
| 3,521,864 | 7/1970 | Welles, Jr. | 261/93 X |
| 3,815,879 | 6/1974 | Mikhailov et al. | 261/93 |
| 4,242,289 | 12/1980 | Blum | 261/93 |
| 4,265,739 | 5/1981 | Dalton | 261/93 X |
| 4,305,894 | 12/1981 | Lindblom | 261/93 |

FOREIGN PATENT DOCUMENTS

| | | | |
|---|---|---|---|
| 2231061 | 1/1974 | Fed. Rep. of Germany | 261/93 |

*Primary Examiner*—Richard L. Chiesa

*Attorney, Agent, or Firm*—Steinberg & Raskin

[57] ABSTRACT

Aeration apparatus for aerating a liquid to be treated in an aeration tank. The aeration apparatus has an impeller by means of which the liquid is displaced through an annular discharge passage defined between an outer casing and an inner casing disposed coaxially in the outer casing at a predetermined distance from the latter. The outlet end of the annular discharge passage opens in a substantially horizontal direction and radially outwardly. A gas supplying device provided in the annular discharge passage is adapted to supply an oxygen-containing gas to the liquid flowing in the annular passage.

22 Claims, 12 Drawing Figures

AERATION APPARATUS

BACKGROUND OF THE INVENTION

The present invention relates to an aeration apparatus for purifying contaminated water in a sewage treatment plant, such as a factory drainage treatment station, a municipal sewage treatment station, and the like. More particularly, the invention relates to an aeration apparatus having a casing which is provided with a passage for the liquid to be treated, an impeller disposed in the passage, and an oxygen-containing gas injection mechanism adapted for injecting the gas into the passage.

In the aeration apparatus of the type mentioned above, a gas-liquid recirculating flow is forcibly generated in an aeration tank so as to improve the aeration efficiency. Typical examples of conventional aeration apparatus of the type mentioned above are shown in FIGS. 1 and 2.

In the aeration apparatus shown in FIG. 1, an impeller 2 adapted to be driven by a motor 1 is disposed in a casing 3, so that the liquid flows upwardly or obliquely upwardly from the lower side as indicated by an arrow A. Air is introduced through an air supply pipe 4 to effect the aeration.

The aeration apparatus shown in FIG. 2 is of the type adapted to be kept afloat on the liquid surface by the buoyancy of a float 5. The liquid to be treated is made to flow as indicated by an arrow B from the upper to the lower side by an impeller 7 driven by a motor 6 and the aeration is effected by the air supplied through an air pipe 8.

These known apparatus themselves are effective but still suffer from a fundamental problem in that they cannot satisfactorily improve the aeration efficiency because the gas-liquid mixture is not circulated to the extremities of the aeration tank. Particularly, in the conventional apparatus shown in FIG. 1, there is a serious problem in that the aeration performance is undesirably lowered due to precipitation of the activated slurry which results from a flow velocity which is unduly low at the bottom of the aeration tank.

It has also been found that, in the aeration apparatus of the downward discharge type exemplified by the apparatus shown in FIG. 2, the aeration performance is seriously affected when the oxygen-containing gas injection port opening into the liquid passage in the apparatus is located too close to the upstream or downstream end of the impeller. For example, when the oxygen-containing gas is introduced at a position just upstream from the impeller, the suction side of the impeller is blocked by the gas if the gas supply rate is too large, so that the impeller fails to displace the water. In consequence, the gas is not drawn in and the flow direction of the liquid to be treated is undesirably reversed to the suction side.

In the case where the gas is supplied to the region just downstream from the impeller, the gas is gradually accumulated and will occupy the entire space in which the impeller is situated if the gas supply rate is too large. In consequence, the impeller becomes inoperative and the gas is not discharged from the discharge port. As a result, the liquid to be treated is undesirably displaced back toward the suction port due to the buoyancy of the gas bubbles. In both cases, the aeration performance is seriously deteriorated because of lack of recirculating flow of the gas-liquid mixture.

SUMMARY OF THE INVENTION

Accordingly, an object of the invention is to provide an aeration apparatus capable of effectively recirculating the gas-liquid mixture through the entire aeration tank with comparatively small reduction in the flow velocity of the mixture.

Another object of the invention is to provide an improved aeration apparatus which eliminates the unfavorable effect on the impeller caused by introduction of the oxygen-containing gas into the passage of the liquid to be treated, thereby improving the aeration efficiency.

Still another object of the invention is to provide an aeration apparatus capable of eliminating the possibility of the gap between the impeller and the casing being jammed by solid matters contained in the liquid to be treated.

A further object of the invention is to provide an aeration apparatus capable of eliminating the reversing of the direction of the liquid flow into the gas supply pipe, even when a compressor or a blower acting as the oxygen-containing gas source is accidentally stopped.

Still other objects and advantages of the invention will in part be obvious and will in part be apparent from the specifi- cation.

Generally speaking, in accordance with the present invention, there is provided an apparatus for aerating a liquid to be treated in an aeration tank. The aeration apparatus comprises a tubular outer casing including an axis, driving means disposed in said outer casing, an impeller adapted to be driven by the driving means to thereby feed the liquid to be treated, an inner casing disposed at the inner side of the outer casing at a predetermined distance from the outer casing, so as to define an annular discharge passage for the liquid to be treated, and a gas supplying means having gas discharge ports for supplying an oxygen-containing gas into the liquid to be treated flowing through the annular discharge passage, wherein the annular discharge passage defined by the outer casing and the inner casing has a discharge end which opens radially outwardly in the direction substantially perpendicular to the aforementioned axis, and the liquid to be treated is sucked from one end of the outer casing and is discharged from the discharge end of the annular discharge passage.

In a preferred embodiment of the invention, the discharge passage is formed by the outer casing and the inner casing which is coaxial with the latter, and gently bends or curves from the direction substantially parallel to the aforementioned axis to a direction substantially perpendicular to the same. The gas discharge ports are arranged within a particular region between the impeller and the discharge opening of the discharge passage such that the meridian streamline makes an angle of between about O° and 60° to the horizontal. In this embodiment of the invention, the ratio L/H of the distance L between the gas discharge ports and the outlet opening of the discharge passage along the meridian streamline to the height H of the blades of the impeller is selected substantially in accordance with the condition of $0.5 \leqq L/H \leqq 2.5$.

According to another preferred embodiment of the invention, at least one recess is formed in the portion of the outer casing surface which faces the tips of the impeller blades.

According to still another preferred embodiment of the invention, the gas supplying means includes a high-pressure gas source, a gas supply pipe connected to the gas source and surrounding the outer casing and a plurality of gas discharge pipes each having at least one gas discharge port and extending from the gas supply pipe into the discharge passage.

According to a further preferred embodiment of the invention, the gas supplying means includes a high-pressure gas source, a gas supply pipe connected to the gas source, a gas chamber connected to the open end of the gas supply pipe and gas discharge ports provided in the gas chamber, wherein the gas chamber is formed by partitioning a part of the inner casing, and the gas discharge ports are provided in a plurality of projections which project into the discharge passage from the inner casing which functions as the gas chamber.

According to a still further preferred embodiment of the invention, the ratio a/b of the distance a between the inner casing end constituting the outlet end of the discharge passage and the end of the apparatus adjacent to the discharge end as measured in the direction of the aforementioned axis to the distance b between the outer casing and inner casing at the discharge end of the discharge passage has a value which is about 3 or less.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 3:
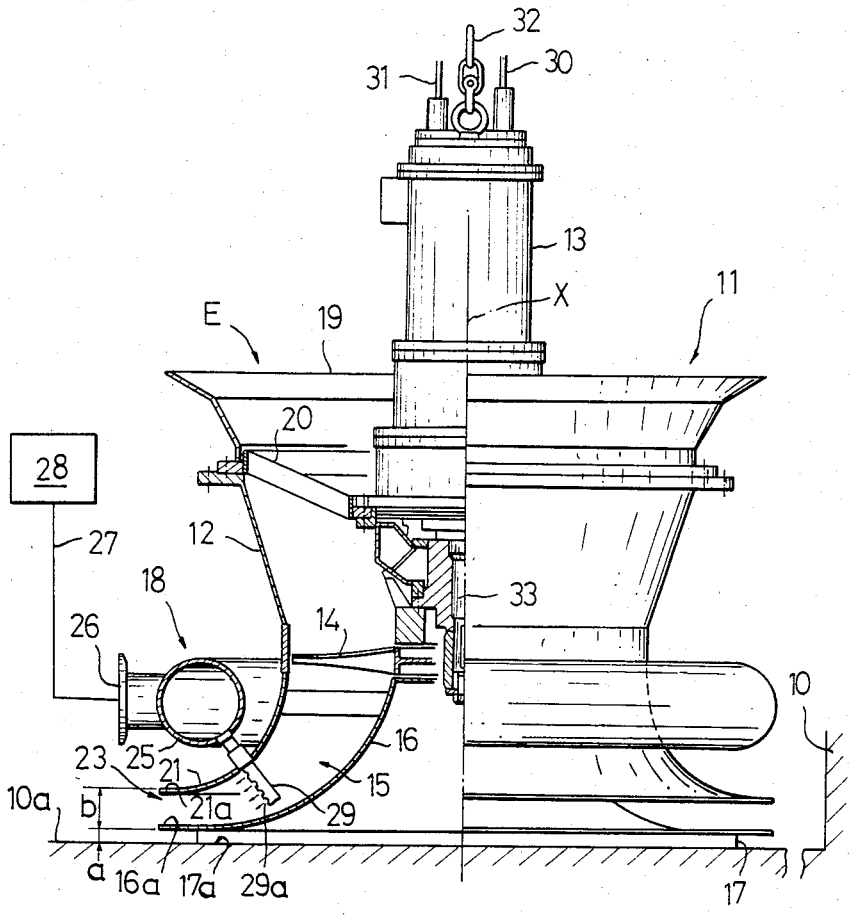
FIG. 3 is a partly-sectioned side elevational view of an aeration apparatus in accordance with an embodiment of the invention.

Referring to FIG. 3, an aeration apparatus 11 according to the invention is mounted on the bottom 10*a* of an aeration tank 10. The aeration apparatus 11 has a generally cylindrical outer casing 12 forming a passage for a liquid to be treated (referred to hereinbelow simply as "liquid"), and including an axis X, a motor 13 supported by the outer casing 12, and an impeller 14 adapted to be driven by the motor 13 and for feeding the liquid as described below. A bell-shaped inner casing 16 is disposed in the lower part or region of the internal space of the outer casing 12 coaxially with and at a predetermined distance from the latter, so as to define with the outer casing 12 an annular discharge passage 15 for the liquid. The inner casing 16 is mounted on a base 17. Furthermore, the aeration apparatus 11 has a gas supplying device, generally designated 18, for supplying an oxygen-containing gas to the liquid flowing in the annular discharge passage 15.

The upper end of the outer casing 12 constitutes an inlet opening 19, and the aforementioned impeller 14 driven by the motor 13 is mounted within the outer casing 12 at the mid-portion thereof in a manner known per se. For example, the motor 13 may be a submerged geared motor supported on the outer casing 12 through a support 20.

In the illustrated embodiment, the outer casing 12 has a tubular form wherein the portion thereof which extends above the impeller 14 diverges outwardly in the upward direction. The radially central portion of the internal space within the outer casing 12 along the axis X accommodates a pump unit including the motor 13 and the impeller 14. The annular discharge passage 15 at the lower part or region of the outer casing 12 is formed by a downwardly diverging, bell-shaped plate 21 connected to and forming a part of the outer casing 12 and the aforementioned bell-shaped inner casing 16 which is disposed radially inwardly of the plate 21 and which also diverges outwardly in the downward direction. It will be understood that by the cooperation between the plate 21 and the inner casing 16, the liquid which is discharged downwardly from the impeller 14 is gradually deflected outwardly to flow in a direction which is generally perpendicular to the axis of the outer casing 12, i.e. in a substantially horizontal direction. The liquid is then discharged horizontally and radially outwardly from the passage 15 through an annular outlet opening 23.

The gas supplying device 18 includes an annular gas supply pipe 25 disposed around the outer casing 12. The gas supply pipe 25 has a gas inlet port 26 at which it is connected through a pipe 27 to an external high-pressure gas source 28 of oxygen, air or the like, e.g. an air compressor, blower or the like. A plurality of gas discharge pipes 29 extend at various respective circumferential locations from the gas supply pipe 25 into the discharge passage 15. The gas discharge pipes 29 also function as stays for securing the gas supply pipe 25 on the outer casing 12. Each gas discharge pipe 29 is provided with a plurality of ports 29*a* for discharging oxygen or air into the discharge passage 15. Reference numeral 30 denotes a submerged cable through which power is supplied to apparatus while numeral 31 denotes a submerged cable for various safety devices. A chain for suspending the aeration apparatus 11 and a drive shaft of the motor 13 are designated by reference numerals 32 and 33, respectively.

The gas supplying device 18 will be described in more detail with specific reference to FIG. 4. In the illustrated embodiment of the invention, the location of the ports 29*a* of the gas discharge pipes 29 for supplying the gas into the liquid is preferably selected in a manner such that an unfavorable effect of the buoyancy of gas on the flow of the liquid is avoided.

More particularly, the discharge ports 29*a* of the gas discharge pipe 29 are located preferably within such a region between the impeller 14 and the outlet opening 23 that the meridian streamline and the horizontal line form an angle of between about 0° and 60°, more preferably between about 25° and 50°. Furthermore, since the dissolution of oxygen proceeds very rapidly in the closed annular passage 15 between the discharge ports 29*a* of the gas discharge pipe 29 and the outlet opening 23 as compared with the free flow of fluid downstream from the outlet opening 23, it is preferred to preserve as large a distance as possible between the discharge ports 29*a* of the gas discharge pipe 29 and the outlet opening 23. This distance, however, cannot be increased in an unlimited manner mainly due to the reasons concerning impeller performance. Preferably, the above-mentioned distance L along the meridian streamline is selected in relation to the height H of the impeller blade substantially to meet the condition of $0.5 \leqq L/H \leqq 2.5$.

In this manner, it is possible to eliminate any substantial influence of the gas on the impeller 14, so that the rate of aeration can be increased. In addition, the liquid and the supplied gas are sufficiently mixed with each other in the portion of the annular discharge passage 15 downstream from the discharge ports 29*a* of the discharge pipe 29. In consequence, the aeration performance is remarkably improved.

Figure 4:
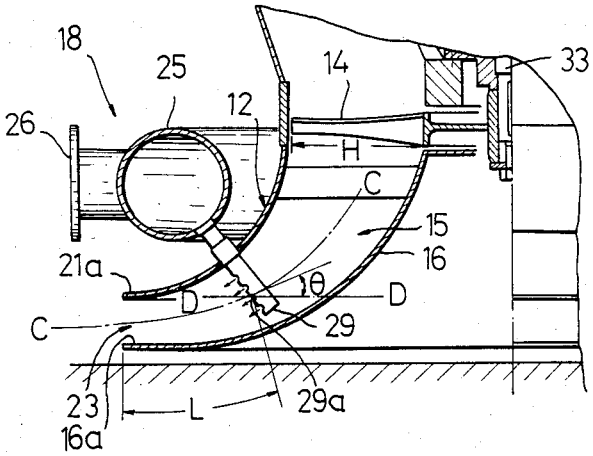
FIG. 4 is a detail view in section of an embodiment of the invention illustrating the position of the air discharging ports.

Referring further to FIG. 4, the portion of the annular passage 15 between the impeller 14 and the outlet opening 23, formed by the outer casing 12 and the inner casing 16, takes the form of a nozzle having a flared or bell-like shape. As noted above, the discharge ports 29*a* of the gas discharge pipe 29 are positioned in such a region between the impeller 14 and the outlet opening 23 that the meridian streamline C—C (C—C represents one of the streamlines) and a horizontal line D—D intersect at an angle $\theta$ which is in the range of between about O° and 60°, preferably between about 25° and 50°. In the illustrated embodiment, this angle $\theta$ is 45°. The ratio L/H of the distance L between the discharge ports 29*a* of the discharge pipe 29 and the outlet port 23 along the meridian line to the blade height H of the impeller 14 is preferably substantially in accordance with the condition of $0.5 \leqq L/H \leqq 2.5$. In the illustrated embodiment, this ratio L/H is selected to be 1.3.

As will be seen from FIG. 3, the aeration apparatus 11 shown in FIGS. 3 and 4 is designed and constructed such that a ratio a/b has a value which is not greater than about 3, where a represents the distance between the bottom 1O*a* of the aeration tank 10 and the lower end of the outlet opening 23, i.e. the lower end 16*a* of the inner casing, while b represents the height of the outlet opening 23, i.e. the vertical distance between the lower end 21*a* of the plate 21 forming a part of the outer casing 12 and the lower end 16*a* of the inner casing 16. In other words, the distance a between the lower end 17*a* of the body of the aeration apparatus 11 and the outlet opening 23 and the height b of the outlet opening 23 are selected such that the ratio a/b has a value not greater than 3.0.

Figure 1:
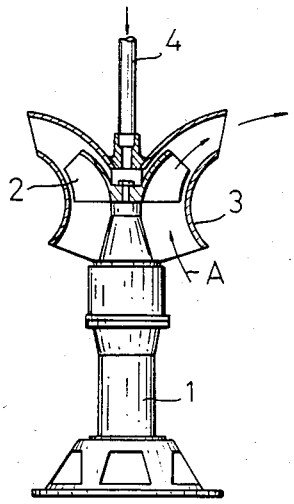
FIG. 1 PRIOR ART
FIG. 1 is a partly-sectioned side elevational view of a conventional aeration apparatus.
Figure 2:
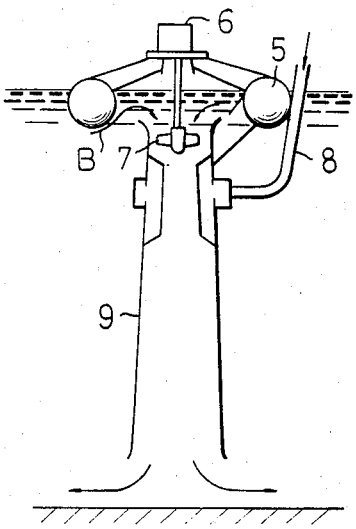
FIG. 2 PRIOR ART
FIG. 2 is a schematic sectional side elevational view of another conventional aeration apparatus.

In operation of the embodiment shown in FIGS. 3 and 4, as the motor 13 is started, the impeller 14 attached to the end of the shaft 33 of the motor 13 is rotated so that the liquid in the aeration tank 10 is sucked as indicated by an arrow E through the inlet opening 19 and is discharged to the area near the bottom 10*a* of the aeration tank 10 from the outlet opening 23 in the horizontal direction, i.e. in a direction substantially parallel to the tank bottom 10*a*. Meanwhile, oxygen or air is supplied through the discharge ports 29*a* of each gas supply pipe 29, and is mixed and stirred with the liquid to form a gas-liquid mixture. In the conventional apparatus shown in FIGS. 1 and 2, the flow of the mixture is strongly decelerated due to the presence of still water at the upper and lower sides thereof. In the apparatus of the illustrated embodiment, however, the deceleration of the mixture flow due to the presence of still water is significantly suppressed since it is substantially devoid of the presence of still water at least at the lower side of the mixture flow or, even if not devoid, the amount of still water at the lower side is minimal. In consequence, the deceleration of the flow of the liquid as a whole is very small.

Figure 5:
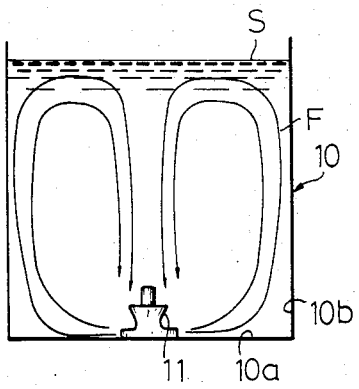
FIGS. 5 and 6 are elevation views of aeration apparatus of downward discharge and upward discharge types respectively, in aeration tanks and illustrating the differences in the respective flow patterns of the liquid to be treated.

As illustrated in FIG. 5, the mixture discharged from the aeration apparatus 11 first flows radially outwardly along the bottom 1O*a* of the aeration tank 10 and then ascends along the side walls 1O*b* of the aeration tank 10. The flow is then directed radially inwardly in the region near the surface S of the liquid and is then turned downwardly in the area above the aeration apparatus 11. This flow of liquid is indicated by arrows F in FIG. 5. In consequence, the gas-liquid mixture is circulated to the extremities, i.e., to each corner of the aeration tank 10 to remarkably improve the aeration performance. In addition, since a sufficiently high flow velocity is maintained even in the area near the tank bottom 1O*a*, the precipitation of the activated slurry is suppressed to contribute to the improvement in the aeration efficiency.

Figure 6:
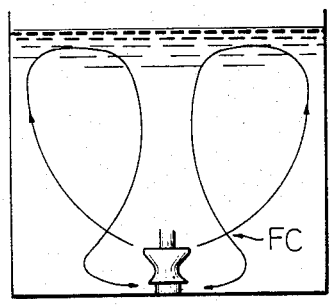

In the illustrated embodiment of the invention, the impeller is installed to have a vertical axis of rotation, and the liquid is caused to flow by the impeller in a substantially downward direction, i.e. from the upper side to the lower side or from the upper side to the lower lateral side of the apparatus. This arrangement causes the gas-liquid mixture to flow along the bottom of the aeration tank which in turn permits an efficient use of the depth of the liquid to be treated. This also contributes to an improvement in the aeration performance. In the conventional aeration apparatus of the upward discharge type, there is a cross flow region FC where the flow components of the mixture cross each other, as shown in FIG. 6. This cross flow region, however, is completely eliminated in the downward discharging type apparatus as seen from FIG. 5. In consequence, the deceleration of the flow attributable to the collision of flow components is avoided to ensure higher flow velocity of the liquid in the aeration tank.

In the illustrated embodiment of the invention, as stated before, the portion of the annular passage between the impeller and the outlet opening, defined by the outer casing and the inner casing, has the form of a nozzle of a bell-like or flared shape, and the distance between the gas discharging ports and the outlet opening of the annular passage is selected to meet the condition of $0.5 \leqq L/H \leqq 2.5$. In this manner, the undesirable deceleration of the flow which would be caused by the presence of external still water downstream of the location where the gas is supplied, is avoided and the liquid and the gas are mixed with each other sufficiently while they flow towards the outlet opening of the annular passage.

The downward discharging type impeller generally has a tendency to decrease the rate at which the gas can be supplied. However, in the illustrated embodiment of the invention, it is possible to increase the rate of supply of the gas because the unfavorable effect of the gas on the impeller is eliminated due to the location of the gas discharge ports being selected in the region of the angle $\theta$ between 0° and 60° as described above. In consequence, the treating capacity of the aerator of given dimensions is increased to improve the aeration performance.

Although an axial flow impeller is used in the illustrated embodiment, other types of impellers, such as mixed flow and centrifugal impellers, may be utilized within the scope of the invention. It is possible to use an ordinary submerged motor in place of the submerged geared motor. In the illustrated embodiment of the invention, the gas is discharged from the gas discharge pipes, each of which has the form of a perforated pipe. This particular arrangement, however, may be modified without losing the advantages of the invention. For instance, the perforated gas discharge pipes may be replaced by providing the wall of the outer casing or the inner casing with apertures as in another embodiment which will be described later, a punched perforated plate or slit-like openings.

Figure 7:
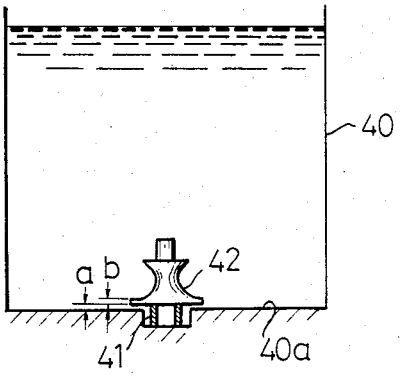
FIG. 7 is a side elevational view of an example of a system including an aeration apparatus of the invention mounted in an aeration tank.

In some cases, the bottom of the aeration tank on which the aeration apparatus of the described embodiment is to be installed partly protrudes or is recessed. In such a case, the portion of the surface presenting the greatest planar area should be regarded as being the tank bottom. For instance, FIG. 7 shows a case where the bottom 40*a* of an aeration tank is partly recessed. In this case, the aeration apparatus 42 is mounted on upright standing legs 41 extending from the bottom of the recess, such that the outlet opening is so positioned as to result in the ratio a/b having a value not greater than 3.0 as explained before in connection with FIG. 3. On the other hand, when the tank bottom is partly protruded, the aeration apparatus is situated on the tank bottom 40*a* directly.

Hereinafter, another embodiment of the invention will be described with specific reference to FIGS. 8 and 9.

The aeration apparatus of this embodiment has a basic structure similar to that shown in the preceding embodiment illustrated in FIGS. 3 and 4, but further includes structure for effectively preventing solid material which may be suspended in the liquid being treated from becoming jammed in the space between the impeller tip and the outer casing.

Figure 8:
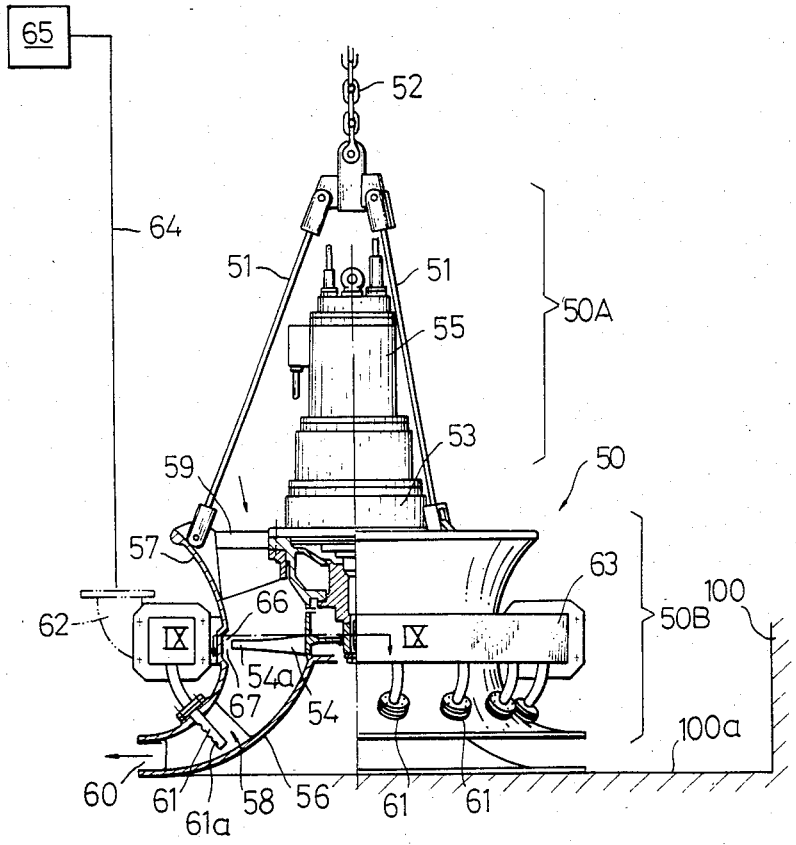
FIG. 8 is a partly-sectioned side elevational view of another embodiment of aeration apparatus in accordance with the invention.
Figure 9:
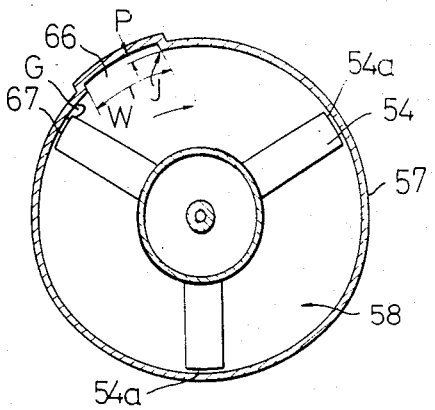
FIG. 9 is a sectional view taken along the line IX—IX of FIG. 8.

Referring to FIGS. 8 and 9, the aeration apparatus 50 of this embodiment is constituted by a driving section 50A and a casing section 50B and is suspended by a chain 52 through a suspension member 51 so as to be situated on the bottom 100*a* of the aeration tank. Since this aeration apparatus 50 is immersed in the liquid, the driving section 50A incorporates a submerged motor 55 which drives an impeller 54 through a transmission 53. The casing section 50B is composed of an inner casing 56 and an outer casing 57 which cooperate with each other in defining an annular passage 58 therebetween. Both casings 56, 57 are diverged downwardly in a bell-like form. As the submerged motor 55 is started, the impeller 54 is driven to draw the liquid through the upper inlet opening 59 of the annular passage 58. The liquid is then discharged through an outlet opening 60 in the horizontal and radially outward direction. A suitable number of gas discharging pipes 61 project into the passage 58. An oxygen-containing gas such as air is supplied through an inlet port 62 and is discharged into the liquid flowing in the annular passage 58 through a ring-shaped gas manifold 63 and gas discharge pipes 61. The gas inlet port 62 is adapted to communicate with a source 65 of the oxygen-containing gas through a pipe 64.

Various types of solid matter flow into the aeration tank 100, particularly when the tank is used for sewage treatment, together with the liquid to be treated, e.g. sewage. Such solid matter tend to hinder the safe, reliable and economical operation of the apparatus by inhibiting the rotation of the impeller 54. For instance, should a comparatively large piece of solid matter, such as wooden piece, become jammed in the clearance space between the impeller 54 and the outer casing 57, the power consumption by the submerged motor 55 increases uneconomically in excess of the rated power of the motor, which may then be caused to stop. To avoid this, in this embodiment of the invention, one or more recesses 66 are formed in the portion of the wall of the outer casing 57 which faces the tips of the blades of the impeller 54. The wooden piece or like piece of solid matter can escape from the gap between the impeller and the outer casing as it reaches such a recess.

To explain in more detail with reference to FIGS. 8 and 9, one or more recesses 66 are formed in the portion of the outer casing 57 which is in opposed relationship to the impeller 54, i.e. in the portion of the outer casing 57 located at the radially outer side of the impeller 54. These recesses 66 are intended to allow the release of any solid matter G which may become lodged in the gap 67 between the tip 54*a* of the impeller 54 and the inner peripheral surface of the outer casing 57. The recess 66 has an axial height equal to or somewhat greater than the axial width of the impeller blade tip 54*a* and has a generally rectangular form of a width W ranging between about 100 and 150 mm and a depth P of not greater than about 20 mm. According to this arrangement, even when a large piece of solid matter designated G, such as a wooden piece, is caught in the gap 67 between the tip 54*a* of the impeller 54 and the inner peripheral surface of the outer casing 57, such solid matter G is relieved from the tip 54*a* of the impeller 54 as the blade tip 54*a* of the impeller reaches a location in opposed relationship to the recess 66, so that the impeller 54 can continue to operate in a stable manner. From the viewpoint of safe operation of the aeration apparatus, it is preferred that the angle J formed between the recess 66 and the inner peripheral surface of the outer casing 57 is substantially 90°. Such an arrangement prevents the released solid matter G from being caught again in the gap 67 between the blade tip 54*a* and the inner peripheral surface of the outer casing 57.

In the aeration apparatus 50 of this embodiment, as the submerged motor 55 is started, the liquid is aerated and purified in the manner described above. However, since the recess 66 is formed in the portion of the wall of outer casing 57 facing the impeller 54, the solid matter G, such as a wooden piece, flowing along the inner surface of the outer casing 57 and which happens to be caught in the gap 67 will be released as it reaches the recess 66 and, once released, will never again become jammed between the blade tip 54*a* of the impeller 54 and the surface of the outer casing 57. The aeration apparatus 50 of this embodiment, therefore, can be operated stably without accidental tripping of the motor due to overload so that the reliability of the aeration apparatus as a whole can be increased remarkably.

The arrangement concerning the direction of outlet opening 60 of the annular passage 58 defined by the outer casing 57 and the inner casing 56, the position of the discharge ports 61*a* of the gas discharge pipe 61 and the ratio between the distance from tank bottom 100*a* to the lower end of the outlet opening 60 and the vertical breadth of the outlet opening 60, which are prescribed in connection with the embodiment shown in FIGS. 3 and 4, also applies to the embodiment shown in FIGS. 8 and 9.

Still another embodiment of the invention will now be described with specific reference being made to FIGS. 10 to 12.

This embodiment is distinguished from the preceding two embodiments by incorporating a specific construction of the gas supplying device for supplying the oxygen-containing gas into the annular passage formed between the outer casing and the inner casing.

Figure 12:
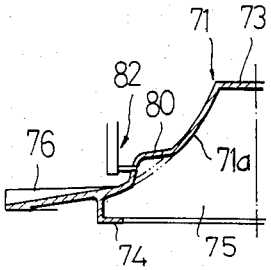
FIG. 12 is a sectional side elevational view of the inner casing shown in FIG. 11, also illustrating the manner in which the discharge ports are formed.
Figure 11:
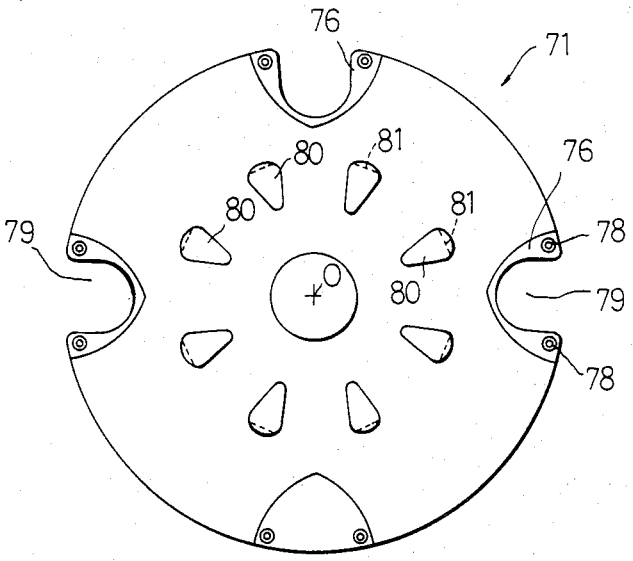
FIG. 11 is a plan view of an example of an inner casing for use in aeration apparatus of the present invention.
Figure 10:
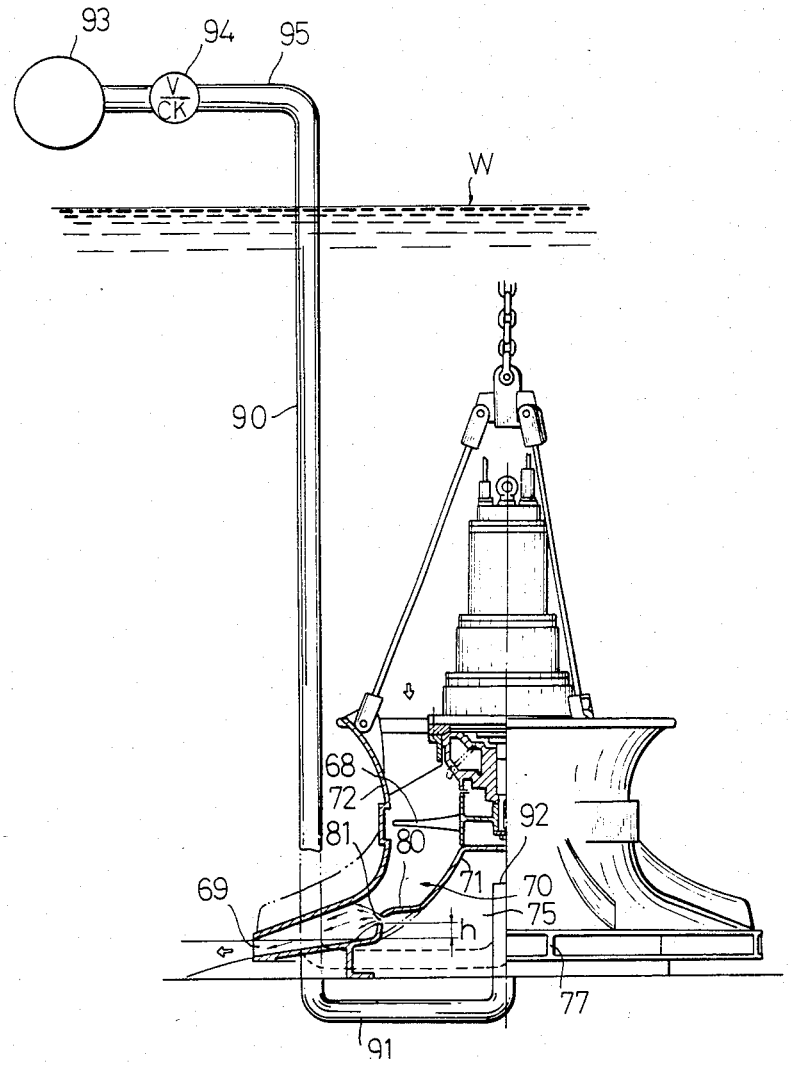
FIG. 10 is a partly-sectioned side elevational view of another embodiment of the aeration apparatus of the present invention.

More particularly, referring to FIGS. 10 through 12, gas discharging ports are located on projections formed on the inner casing so as to project into the annular passage. Also, a check valve is provided in the main supply pipe for the oxygen-containing gas.

Referring to FIG. 10, a passage 70 accommodating an impeller 68 and guiding the flow of the liquid is defined by an inner casing 71 and an outer casing 72, both of which diverge downwardly in a bell-like form so that the liquid is discharged through an outlet opening 69 substantially horizontally and radially outwardly as in the case of the preceding embodiments. In this embodiment, however, as shown in detail in FIG. 12, the bell-shaped curved portion 71*a* of the inner casing 71 is provided at its upper end with a ceiling portion 73 and at its lower end with a radially inwardly bent portion 74. The ceiling portion 73, curved portion 71*a* and the bent portion 74 in combination define a gas chamber 75. As will also be seen from FIG. 11, the inner casing 71 is provided with a plurality of mounting seats 76 (four seats are provided in the illustrated embodiment), by means of which the inner and outer casings 71 and 72 are united to each other through a suitable bracket 77 (FIG. 10) and joined by bolts (not shown) which are screwed into the bolt holes 78. The bracket 77 has a function to restrict the outlet opening to an extent to thereby impart a velocity to the discharged flow of the liquid. As shown in FIG. 11, notches 79 are formed in respective portions of the circumference of the inner casing 71, and a main supply pipe 90, described below, extends through one notch 79 and opens into the gas chamber 75.

More specifically, as shown in FIGS. 11 and 12, a plurality of projections 80 are arranged on an imaginary circle on a part of the curved portion 71*a* of the inner casing 71 at a regular circumferential pitch, so as to project smoothly into the passage 70. Thus, these projections 80 are formed at a regular interval on a circle centered at the center O of the inner casing as viewed in plan. Gas discharge ports 81 are formed in the surfaces of the projections 80 directed toward the downstream side of the annular passage 70.

Preferably, these discharge ports 81 are located at positions corresponding to those described above in connection with FIGS. 3 and 4. In this embodiment, the discharge ports 81 are disposed in such a region between the impeller 68 and the outlet opening 69 that the angle formed between the meridian streamline and the horizontal line is 30°. The ratio of the distance between the discharge port 81 and the outlet opening 69 along the meridian streamline to the height of blade of the impeller 68 is selected to be 2.0. The discharge ports 81 can be formed in a slit-like form in each projection 80 simply by, for example, rotating the inner casing 71 by a lathe (not shown) or the like while contacting a tool 82 (FIG. 12) with the projection 80.

It will be clear to those skilled in the art that the projections 80 may be provided on the outer casing 72 instead of on the inner casing 71.

The main supply pipe 90 for supplying the gas chamber 75 with an oxygen-containing gas such as air has a lower end which is bent substantially in an L-like form with the open end 92 thereof extended into the gas chamber 75 formed within the inner casing 71. The open end 92 is positioned above the discharge ports 81 as viewed in the drawings.

The main supply pipe 90 is connected to an external high-pressure source 93, such as a compressor or a blower, through a horizontal portion 95 extending above the surface W of the liquid to be treated. In the illustrated embodiment, a check valve 94 is disposed in the horizontal portion 95.

In this embodiment, since the gas discharging ports 81 are formed in the projections 80 provided on the inner casing 71, any foreign matter contained in the liquid to be treated will not become caught in the passage 70. Even if the foreign matter happens to become caught, it can be easily removed by the flow of the liquid in the passage 70 since the projections 80 have smooth outer surfaces, so that there is no possibility of blocking the discharge ports 81 and the passage 70. The gas discharging ports 81 can be easily formed with high efficiency by, for example, cutting or punching techniques. In addition, since the inner casing 71 also serves to define the gas chamber 75, the construction of the apparatus as a whole is greatly simplified and the sealing means can advantageously be dispensed with.

Furthermore, the piping work is facilitated because the main supply pipe 90 need only be opened into the gas chamber 75. It is also possible to displace the aeration apparatus upwardly and downwardly as a whole using the main supply pipe 90 as a guide.

In the event that the high-pressure source 93 fails to operate to lower the source pressure, the level of the liquid surface in the gas chamber 75 is raised by a distance designated h (FIG. 10). More particularly, when the gas is discharged through the discharging ports 81, the liquid surface is depressed by a distance h corresponding to the velocity loss head at the discharging ports 81. Any further rise of the liquid level in the gas chamber, however, is avoided in this embodiment by the provision of the check valve 94. Therefore, since the open end 92 of the main supply pipe 90 is located above the gas discharging ports, a reversal of the flow of the liquid into the main supply pipe 90 and the consequent blockage of the main supply pipe are effectively avoided.

This embodiment can be modified in various forms. For instance, the check valve 94 may be mounted in the portion of the main supply pipe 90 which is immersed in the liquid, instead of in the horizontal portion 95. It will also be understood that the gas chamber will be defined by the outer casing 72 when the projections 80 are formed on the outer casing 72. Although such a modification is not shown, a person skilled in the art will readily understand the manner in which such a gas chamber will be constructed. For example, a chamber may be formed by the addition of a wall enveloping the exterior of outer casing 72.

It will thus be seen that the objects set forth above, among those made apparent from the preceding description, are efficiently attained and, since certain changes may be made in the above construction without departing from the spirit and scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An aeration apparatus comprising:

a generally tubular outer casing including an axis generally extending in a substantially vertical direction;

driving means mounted in said outer casing;

an impeller adapted to be driven by said driving means so as to feed a liquid to be treated in a substantially axially and downwardly direction;

an inner casing disposed at the inner side of said outer casing at a predetermined distance from the latter so as to form an annular discharge passage for said liquid; and gas supplying means having gas discharge ports positioned in said discharge passage for supplying an oxygen-containing gas to said liquid in said annular discharge passage;

wherein said annular discharge passage defined by said outer casing and said inner casing has an outlet end opening substantially radially outwardly in a direction substantially perpendicular to said axis, said liquid is sucked through one end of said outer casing and discharged through said outlet end, said discharge passage is defined between said outer casing and said inner casing disposed coaxially with said outer casing, said discharge passage being gradually curved in the direction of flow of the liquid therethrough from a direction substantially downwardly and substantially parallel to said axis to a direction substantially perpendicular to said axis, and said gas discharge ports being disposed in such a region between said impeller and said outlet end of said discharge passage that the angle formed between the meridian streamline of the liquid flow through said discharge passage and the horizontal is in the range of between about 0° and 60°.

2. An aeration apparatus according to claim 1, wherein the ratio L/H of the distance L between said gas discharging ports and said outlet end of said discharge passage along the meridian streamline of the liquid flow through the discharge passage to the height H of the blades of said impeller substantially satisfies the condition of $0.5 \leqq L/H \leqq 2.5$.

3. An aeration apparatus according to claim 2, wherein said gas supplying means further includes a high-pressure source of said gas, a gas supplying pipe connected to said source and surrounding said outer casing, and a plurality of gas discharging pipes extending into said discharge passage from said gas supplying pipe, each of said gas discharging pipes having at least one gas discharging port.

4. An aeration apparatus according to claim 2, wherein said gas supplying means further includes a high-pressure source of said gas, a gas supplying pipe connected to said source, a gas chamber connected to an open end of said gas supplying pipe and gas discharging ports provided on said gas chamber, said gas chamber being at least partially defined by a portion of said inner casing, said gas discharging ports being formed on a plurality of projections projecting towards said discharge passage from said portion of said inner casing defining said gas chamber.

5. An aeration apparatus according to claim 1, wherein at least one recess is formed in a portion of an inner peripheral surface of said outer casing which is in opposed relationship to the blade tips of said impeller.

6. An aeration apparatus according to claim 5, wherein said recess has a height which is at least equal to the axial length of the tips of the blades of said impeller, a width of between about 100 to 150 mm and a depth of not greater than about 20 mm.

7. An aeration apparatus according to claim 6, wherein said recess has substantially orthogonal edges.

8. An aeration apparatus according to claim 1, wherein said gas supplying means further includes a high-pressure source of said gas, a gas supplying pipe connected to said source and surrounding said outer casing, and a plurality of gas discharging pipes extending from said gas supplying pipe into said discharge passage, each of said gas discharging pipes having at least one gas discharging port.

9. An aeration apparatus according to claim 8, wherein at least one recess is formed in a portion of an inner peripheral surface of said outer casing which is in opposed relationship to the blade tips of said impeller.

10. An aeration apparatus according to claim 9, wherein said recess has a height which is at least equal to the axial length of the tips of the blades of said impeller, a width of between about 100 to 150 mm and a depth of not greater than about 20 mm.

11. An aeration apparatus according to claim 10, wherein said recess has substantially orthogonal edges.

12. An aeration apparatus according to claim 1, wherein said gas supplying means further includes a high-pressure source of said gas, a gas supplying pipe connected to said source, a gas chamber connected to an open end of said gas supplying pipe and gas discharging ports provided on said gas chamber, said gas chamber being at least partially defined by a portion of said inner casing, said gas discharging ports being formed on a plurality of projections projecting towards said discharge passage from said portion of said inner casing defining said gas chamber.

13. An aeration apparatus according to claim 12, wherein at least one recess is formed in a portion of an inner peripheral surface of said outer casing which is in opposed relationship to the blade tips of said impeller.

14. An aeration apparatus according to claim 12, wherein said inner casing consists of a substantially bell-like substantially cylindrical member closed at the smaller-diameter end thereof, the region within said inner casing proximate to the closed end thereof at least partly forming said gas chamber, said plurality of projections being disposed on an imaginary circle centered substantially at the center of said inner casing at a predetermined circumferential pitch as viewed in plan.

15. An aeration apparatus according to claim 14, wherein said open end of said gas supplying pipe opens at a location within said gas chamber which is situated closer to the closed end of said inner casing than are said discharge ports.

16. An aeration apparatus according to claim 12, wherein each of said projections has a smooth outer surface, and each of said gas discharging ports comprises a slit formed in the surface of a respective one of said projections directed toward the downstream side of said discharge passage.

17. An aeration apparatus according to claim 12, wherein a check valve is provided in said gas supplying pipe.

18. An aeration apparatus according to claim 1, wherein the ratio a/b of the distance a between an end of said inner casing constituting the outlet end of said discharge passage and the axial end of said apparatus adjacent to said outlet end of said discharge passage to the distance b between said outer casing and said inner casing at said outlet end of said discharge passage has a value not greater than about 3.

19. An aeration apparatus according to claim 1, wherein said outer casing comprises a substantially inverted bell-like first substantially cylindrical member and a substantially bell-like second substantially cylindrical member connected coaxially to said first cylindrical member, and said inner casing has a substantially bell-like structure so that said annular discharge passage is formed by said second cylindrical member of said outer casing and said inner casing.

20. An aeration apparatus according to claim 19, wherein said discharge ports are positioned in such a region between said impeller and said outlet end of said discharge passage that the angle formed between the meridian streamline of the liquid flow through the discharge passage and the horizontal is in the range of between about 25° and 50°.

21. An aeration apparatus according to claim 20, wherein said driving means is supported by said outer casing through support members and includes a submerged geared motor.

22. An aeration apparatus comprising:

a generally tubular outer casing including an axis generally extending in a substantially vertical direction;

driving means mounted in said outer casing;

an impeller adapted to be driven by said driving means so as to feed a liquid to be treated in a substantially axially and downwardly direction;

an inner casing disposed at the inner side of said outer casing at a predetermined distance from the latter so as to form an annular discharge passage for said liquid; and gas supplying means having gas discharge ports positioned in said discharge passage for supplying an oxygen-containing gas to said liquid in said annular discharge passage, said gas supplying means including a high-pressure source of said gas, a gas supplying pipe connected to said source, a gas chamber connected to an open end of said gas supplying pipe and gas discharging ports provided on said gas chamber, said gas chamber being formed by partitioning off a part of said inner casing, said gas discharging ports being formed on a plurality of projections projecting towards said discharge passage from said part of said inner casing serving as said gas chamber;

wherein said annular discharge passage defined by said outer casing and said inner casing has an outlet end opening substantially radially outwardly in the direction substantially perpendicular to said axis;

wherein an inner peripheral surface of said outer casing in opposed relationship to the tips of the blades of said impeller is provided with at least one recess, said liquid is sucked through one end of said outer casing and discharged through said outlet end so as to flow downwardly in said annular discharge passage, said discharge passage is defined between said outer casing and said inner casing disposed coaxially with said outer casing, said discharge passage being gradually curved in the direction of flow of the liquid therethrough from a direction substantially downwardly and substantially parallel to said axis to a direction substantially perpendicular to said axis, and said gas discharge ports being disposed in such a region between said impeller and said outlet end of said discharge passage that the angle formed between the meridian streamline of the liquid flow through said discharge passage and the horizontal is in the range of between about 0° and 60°.

* * * * *